United States Patent [19]

Arinobu

[11] 4,446,081

[45] May 1, 1984

[54] STEAM CONDENSING APPARATUS

[75] Inventor: Mutsuhiro Arinobu, Tokyo, Japan

[73] Assignee: Tokyo Shibaura Denki Kabushiki Kaisha, Kawasaki, Japan

[21] Appl. No.: 490,736

[22] Filed: May 9, 1983

Related U.S. Application Data

[63] Continuation of Ser. No. 187,488, Sep. 16, 1980, abandoned.

[30] Foreign Application Priority Data

Sep. 21, 1979 [JP] Japan ..... 54-121876

[51] Int. Cl.[3] ..... G21C 9/00

[52] U.S. Cl. ..... 261/64 R; 261/124; 261/DIG. 10; 376/283

[58] Field of Search ..... 261/DIG. 10, DIG. 32, 261/124, 64 R; 376/283, 316

[56] References Cited

U.S. PATENT DOCUMENTS

| | | | |
|---|---|---|---|
| 1,959,554 | 5/1934 | Stich | 261/124 |
| 2,050,117 | 8/1936 | Page | 261/124 |
| 3,347,537 | 10/1967 | Morgan | 261/124 |
| 3,606,985 | 9/1971 | Reed | 261/124 |
| 4,022,655 | 5/1977 | Gaouditz et al. | 261/124 |
| 4,139,413 | 2/1979 | Simon et al. | 261/124 |
| 4,252,611 | 2/1981 | Mizumachi et al. | 376/283 |
| 4,305,896 | 12/1981 | Tominaga et al. | 261/124 |

FOREIGN PATENT DOCUMENTS

| | | | |
|---|---|---|---|
| 2248280 | 4/1974 | Fed. Rep. of Germany | 261/DIG. 10 |
| 2622740 | 11/1977 | Fed. Rep. of Germany | 261/124 |
| Ad33,522 | 11/1928 | France | 261/124 |
| 1329087 | 4/1963 | France | 261/124 |
| 51-105505 | 9/1976 | Japan . | |
| 51-130787 | 11/1976 | Japan . | |
| 53-35889 | 4/1978 | Japan | 376/283 |
| 53-99191 | 8/1978 | Japan . | |
| 54-129287 | 10/1979 | Japan | 376/283 |
| 383280 | 12/1964 | Switzerland | 261/124 |

*Primary Examiner*—Tim R. Miles

*Attorney, Agent, or Firm*—Oblon, Fisher, Spivak, McClelland & Maier

[57] ABSTRACT

In a steam condensing apparatus according to this invention, a plurality of branch pipes each having an exhaust nozzle are attached to the distal end of a guide pipe which extends into coolant to eject steam of coolant into the coolant, the branch pipes having different nozzle diameters and/or pipe lengths.

13 Claims, 8 Drawing Figures

FIG. 1
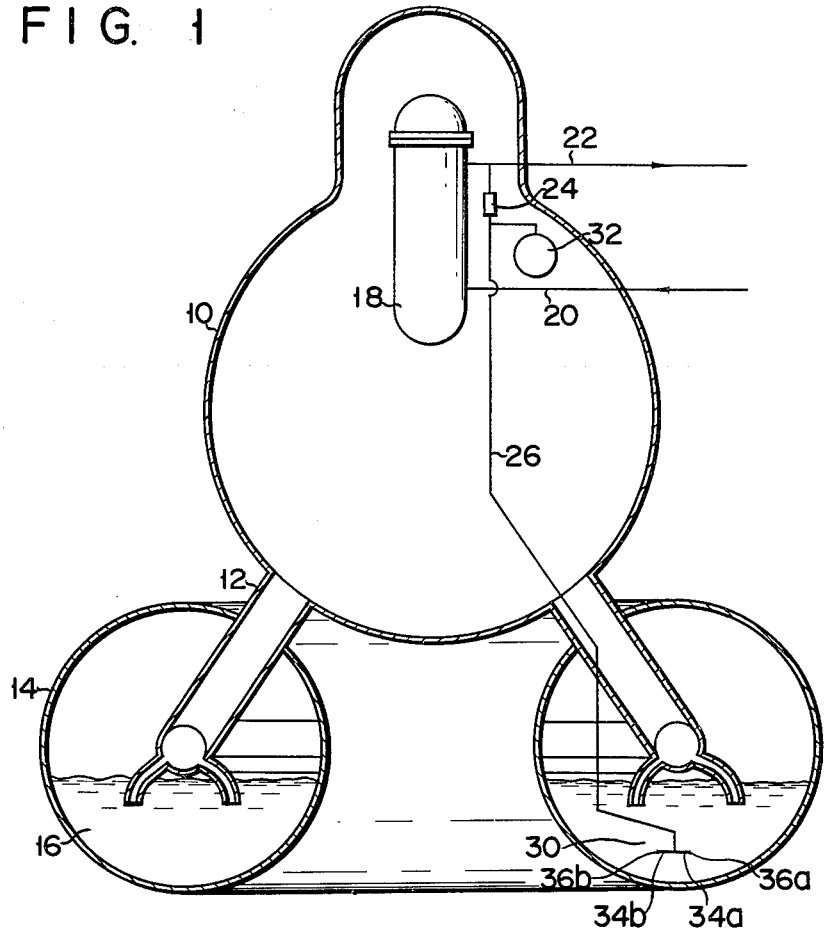
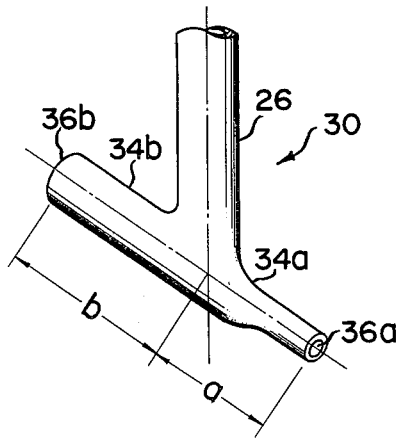
FIG. 2

STEAM CONDENSING APPARATUS

This application is a continuation of application Ser. No. 187,488, filed Sept. 16, 1980, now abandoned.

BACKGROUND OF THE INVENTION

This invention relates to a steam condensing apparatus including a container containing coolant and a guide pipe with its distal end extended into the coolant to lead steam of the coolant into the coolant.

The steam condensing apparatus of this type is generally known. Some of plants that handle steam conventionally use apparatus to operate to lead high-pressure steam discharged from a safety valve into coolant, thereby condensing the steam, when the steam pressure is raised to an excessive level. Typical examples of such plants include boiling water reactor plants. In a conventional boiling water reactor, a core is set in a pressure container which is housed in a housing container. Light water is fed into the pressure container, where it is converted into steam by heat generated from the core, and taken out to be used for driving a turbine, for example. A safety valve to operate when the steam pressure inside the pressure container exceeds a given value is attached to the steam exhaust port of the pressure container. Steam discharged through the safety valve is ejected into coolant or light water in a primary containment vessel used as a coolant container by means of a guide pipe, and condensed.

The aforesaid apparatus for condensing the exhausted steam, which is used as an essential apparatus to constitute a plant, still leaves room for improvement. Such problems will now be described in connection with the apparatus for the aforementioned boiling water reactor plant.

Normally, coolant penetrates into the lower portion of the interior of the guide pipe to substantially the same level as the coolant in the primary containment vessel, thereby forming a column of coolant. In this state, when high-pressure steam from the safety valve flows into the guide pipe, uncondensable gas (hereinafter referred to simply as gas) introduced into the guide pipe is first compressed to force out the coolant from the guide pipe, and then ejected into the coolant. Thereafter, the steam discharged from the safety valve is ejected into the coolant. The gas is compressed first because the coolant will not be able to move quickly due to the inertia of the coolant column and the flow resistance even if gas pressure is applied to the coolant.

Conventionally the guide pipe has two branch pipes of equal length, at each distal end of which is formed a nozzle of same diameter. The gas ejected from the nozzle forms two high pressure bubbles. First expanding in the coolant, the gas bubbles, substantially simultaneously, repeat contraction caused by overexpansion and expansion caused by overcontraction, rise in the coolant while generating oscillatory pressure fluctuations, and leave the surface of the coolant. When the pressure fluctuations reach the inside (wall) of the primary containment vessel, dynamic load is applied to the vessel. Such dynamic load will be hereinafter referred to as load created by bubble oscillation or first dynamic load.

Following the gas ejection from each nozzle, high-pressure steam is ejected into the coolant to form a steam region therein. The higher the flow rate of the ejected steam, the greater the distance covered by the steam region will be. Further, the wider the exhaust nozzle of the guide pipe, the thicker the steam region will be. The configuration of the steam region should be maintained substantially constant as long as the flow rate of steam supplied to the region is balanced with the condensation speed of the steam. Actually, however, it is very difficult to maintain such balance, so that the steam region will repeat expansion and contraction. The expansion and contraction of each region causes pressure fluctuations in the coolant in the primary containment vessel. The pressure fluctuations substantially simultaneously reach the inside of the primary containment vessel and applies dynamic load to the vessel. This dynamic load generated by the steam regions will be hereinafter referred to as second dynamic load. The ejection of the coolant column, gas and steam into the coolant are made successively through each exhaust nozzle attached to the guide pipe.

In the prior art apparatus, as described above, the first and second dynamic loads generated by the gas and steam ejected from two nozzles of a guide pipe are applied to the primary containment vessel in discharging high-pressure steam into the coolant. Accordingly, it is necessary to manufacture the primary containment vessel which has enough mechanical strength to resist those dynamic loads. Naturally, such mechanical strength must be in compliance with the safety standards applicable to reactor plants. If the dynamic loads are great, therefore, the design of the primary containment vessel will become difficult to cause inevitable increase in size and cost of the apparatus. Thus, there is an increasing demand for the development of steam condensing apparatus capable of reducing those dynamic loads.

SUMMARY OF THE INVENTION

The object of this invention is to provide a steam cooling apparatus so designed that dynamic load, generated by pressure fluctuations generated in the coolant, applied to a vessel containing coolant may be reduced when steam of the coolant is led into the coolant for condensation.

In order to attain the above object, the apparatus of this invention is provided with a plurality of branch pipes each having an exhaust nozzle to eject the steam into the coolant at an end portion of the guide pipe extended into the coolant, the branch pipes being different in at least one of fundamental measurements on which the functions of the branch pipes depend.

The fundamental measurements include the diameter of the exhaust nozzle of each branch pipe and the pipe length. By using such plurality of branch pipes with different fundamental measurements, as described later in detail in connection with preferred embodiments of the invention, the time for the start of ejection of the uncondensable gas from the several branch pipes prior to the ejection of the steam can be staggered. Further, the sizes of the gas bubbles ejected from the branch pipes can be changed to vary the frequencies of bubble oscillations. Moreover, the sizes of steam regions formed adjacently to the respective exhaust nozzles of the branch pipes at ejection of steam and hence the frequencies of pressure fluctuations generated from the steam regions may be varied. The pressure fluctuations started at staggered times and with different oscillation frequencies are propagated in the coolant at an extremely high speed (1,000 m/sec or more) to reach the inside (wall) of the vessel. The period of fluctuations of the coolant is much longer than the time required for such propagation. Accordingly, the pressure fluctuations corresponding to the several branch pipes reach the vessel in different phases and are combined thereat substantially the moment they are generated, so that the dynamic loads applied to the vessel can be reduced by proper selection of the fundamental measurements of the branch pipes in order that the pressure fluctuations from the branch pipes may offset each other when they reach the vessel. Thus, the design of the vessel is facilitated to enable reduction in size of the vessel and to improve the safety property thereof.

BRIEF DESCRIPTION OF THE DRAWINGS

FIG. 1 is a schematic view of a boiling water reactor using a steam condensing apparatus according to this invention;

FIG. 2 shows an embodiment of an exhaust section shown in FIG. 1;

DETAILED DESCRIPTION OF THE PREFERRED EMBODIMENTS

Figure 3A:
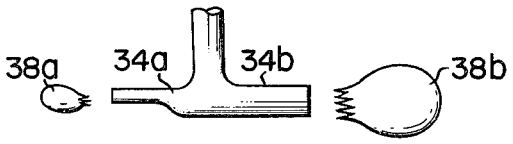
FIG. 3A shows the exhaust section of FIG. 2 and gas bubbles ejected from the exhaust section.

FIG. 1 shows an outline of a boiling water reactor to which the apparatus of this invention is applied. Under a housing container 10, there is an annular primary containment vessel 14 which communicates with the housing container 10 by means of connecting pipes 12 and contains coolant 16. A pressure container 18 containing a core (not shown) therein is set in the housing container 10, and coolant or light water is externally introduced into the pressure container 18 by means of piping 20. The light water is evaporated by heat generated in the pressure container 18, and supplied to an external apparatus (not shown) by means of piping 22.

The junction between the piping 22 and the pressure container 18 is connected with a safety valve 24 which opens to exhaust steam inside the piping 22 when the steam pressure inside the pressure container 18 exceeds a predetermined level. The steam exhaust port of the safety valve 24 is connected with one end side of a guide pipe 26 the other end of which extends downward inside the housing container 10 to pass through one of a plurality of connecting pipes 12, and plunges into the coolant 16 in the primary containment vessel 14. An exhaust section 30 with a plurality of branch pipes is provided at the distal end of the guide pipe 26. The steam discharged from the safety valve 24 is ejected into the coolant 16 through the guide pipe 26 and the branch pipes. When the pressure inside the guide pipe 26 falls below a level near the atmospheric pressure, uncondensable gas at approximately 1 atm. is introduced through a vacuum breaker 32 into the guide pipe 26. The exhaust section 30 at the distal end of the guide pipe 26 protrudes from the distal end, including a plurality of branch pipes that are different in at least one of two fundamental measurements. Such two fundamental measurements include the diameter of the exhaust nozzle at the distal end of the branch pipe and the pipe length.

FIG. 2 shows an embodiment of the exhaust section 30. The exhaust section 30 has two branch pipes 34*a* and 34*b* protruding from the distal end of the guide pipe 26 in opposite directions. The diameter of an exhaust nozzle 36*a* of the branch pipe 34*a* and the length of the branch pipe 34*a* are represented by Da and a respectively, while the diameter of an exhaust nozzle 36*b* of the branch pipe 34*b* and the length of the branch pipe 34*b* are represented by Db and b respectively.

Now there will be described the functions of the branch pipes. In the normal operating state of the boiling water reactor of this example, the guide pipe 26 is filled with air at approximately 1 atm., and the surfaces of the coolant in and outside the guide pipe 26 are substantially at the same level. This state is recovered immediately after the safety valve 24 of the reactor has operated. Namely, even if negative pressure is created inside the guide pipe 26 due to the condensation of steam when the safety valve 24 is closed after opening to discharge excessive steam, air at approximately 1 atm. is introduced from the vacuum breaker 32 into the guide pipe 26.

Figure 3B:
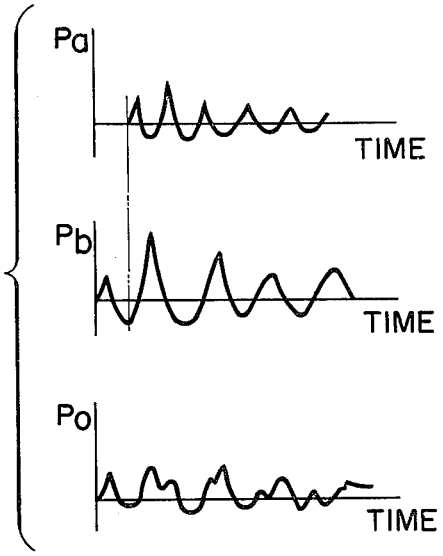
FIG. 3B is a graph showing pressure fluctuations generated in the coolant by bubble oscillation of the apparatus of FIG. 3A as well as variations of composite oscillation.

Now let it be supposed that the measurements of the branch pipes 34*a* and 34*b* of FIG. 2 are given as $a=b$ and $Da<Db$. When the safety valve 24 operates to discharge high-pressure steam from above into the guide pipe 26, the coolant at the bottom end of the branch pipes is ejected at flow rates proportional to the cross-sectional areas of the exhaust nozzles 36*a* and 36*b*. The branch pipe 34*a* requires a shorter time for the through exhaust of the coolant therein than the branch pipe 34*b* does; the former starts gas ejection earlier than the latter. Because of such time delay and the relationship $Da<Db$, the amount of gas or the size of a gas bubble ejected from the branch pipe 34*b* is larger than the size of a gas bubble ejected from the branch pipe 34*a*. Moreover, the oscillation frequency of pressure fluctuations of coolant created by expansion and contraction of the bubble generated from the branch pipe 34*a* is higher than that of pressure fluctuations of coolant created in the same manner by the bubble generated from the branch pipe 34*b*. FIG. 3A schematically shows the configuration of the exhaust section 30 and the size of bubbles 38*a* and 38*b* ejected therefrom under the aforesaid conditions. FIG. 3B shows time-based changes of pressure Pa and Pb and a pressure Po composed from these pressures at a suitable point on the inside (wall) of the primary containment vessel 14 due to the pressure fluctuations generated respectively by the oscillations of the gas bubbles 38*a* and 38*b*. As may be seen from the curves Pa, Pb and Po, the pressure Pb is generated and reaches the vessel earlier than the pressure Pa, and these pressures Pa and Pb have different oscillation frequencies, and the composite pressure has a peak value smaller than the sum of the peak values of the pressures Pa and Pb since these pressures Pa and Pb partially offset each other. Since the amount and pressure of the gas ejected are substantially equal to those of the steam ejected, dynamic load applied to the container by the apparatus of this invention is smaller than the dynamic load applied by the prior art apparatus.

Following the aforementioned gas exhaust, the steam is ejected into the coolant. In this case, the steam from the branch pipe 34b is ejected through an exhaust nozzle of a larger caliber at a higher flow rate, as compared with the steam from the branch pipe 34a. Accordingly, a steam region formed at the tip end of the exhaust nozzle 36b is thick and long, while a steam region formed at the tip end of the exhaust nozzle 36a is thinner and shorter. The length of each such steam region depends on the speed of condensation of the steam at the periphery of the region and the amount of steam ejected from the exhaust nozzle, while the shape of the steam region will never be maintained substantially constant, oscillatorily repeating extension and contraction. The frequency of such oscillation is called oscillation frequency f of steam condensation which may, according to a study made by the inventor hereof, be given by $$f = A\frac{V}{D}\left(\frac{\rho_W}{\rho_V}\cdot\frac{\Delta T}{L}\right)^{1.4} \quad (1)$$

Here V is the flow rate of steam, D is the diameter of exhaust nozzle, $\rho_W$ is the coolant density, $\rho_V$ is the steam density, L is the latent heat of cooled steam, $\Delta T$ is the temperature difference between steam and coolant, and A is a constant. Evidently, the oscillation frequencies f with respect to the branch pipes 34a and 34b respectively are different because these branch pipes 34a and 34b are supposed to be equal in length and different in nozzle diameter, and to share other terms of equation (1) than D in common. Therefore, the pressure fluctuations generated in the steam regions of the branch pipes 34a and 34b accompanying the steam condensation have different oscillation frequencies, and will reach the vessel and be combined to apply second dynamic load thereto. In this case, like the case of the first dynamic load based on the bubble oscillation, the second dynamic load will be smaller than the one obtained with the prior art apparatus using a single exhaust nozzle.

As described above, since the first and second dynamic loads applied to the primary containment vessel 14 are reduced, the design of the vessel 14 is facilitated, resulting in an improvement of the safety property of the vessel and a reduction in cost.

In the case of the aforementioned embodiment, such conditions as a=b and Da=Db must be avoided. Otherwise, the use of the branch pipes will come to naught because the combined value of the pressure fluctuations attributable to the two branch pipes 34a and 34b including both the pressure oscillation created by the gas bubbles and the pressure oscillation generated by the steam condensation is substantially twice as large as the value of the pressure fluctuations attributable to each of the branch pipes.

Figure 4:
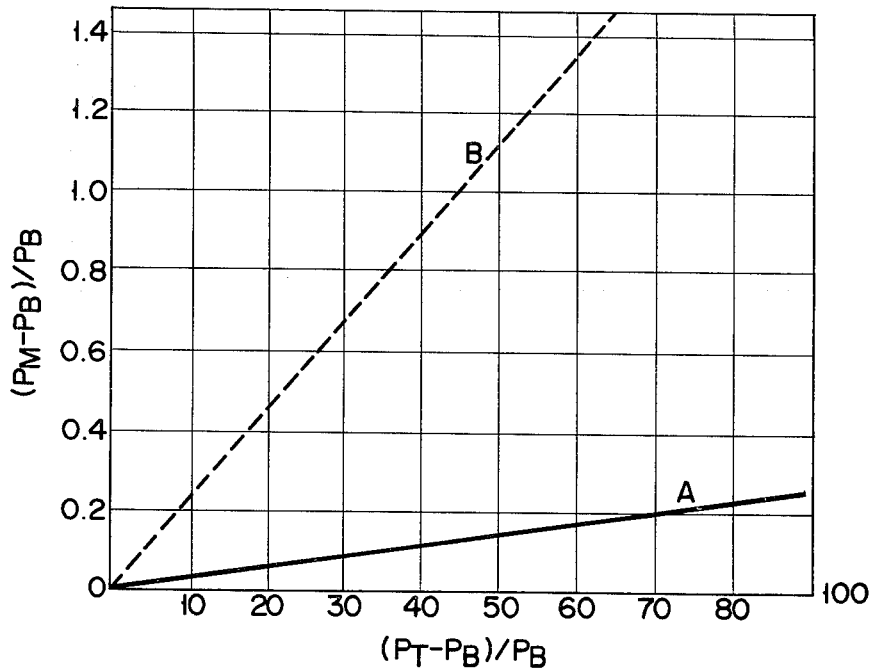
FIG. 4 is a graph showing an effect obtained by using the exhaust section of FIG. 2 with the steam condensing apparatus of FIG. 1.

FIG. 4 is a graph showing the relationship between $P_M$, $P_T$ and $P_B$ plotted with $(P_T-P_B)/P_B$ as the axis of abscissa and $(P_M-P_B)/P_B$ as the axis of ordinate where $P_T$ is the pressure of high-pressure steam discharged from the safety valve 24, $P_B$ is the pressure in the space above the coolant inside the primary containment vessel 14, and $P_M$ is the maximum bottom pressure at a suitable point on the bottom of the vessel 14, using the steam exhaust section 30 so designed that the branch pipes 34a and 34b are equal in length and that the cross-sectional area of the exhaust nozzle of one branch pipe is ½ of that of the exhaust nozzle of the other. In FIG. 4, a solid line (straight line A) represents a case where the cross-sectional areas of the two exhaust nozzles are different, while a broken line (straight line B) represents a case where the cross-sectional areas are equal. As may be seen from this drawing, the maximum pressure applied to the bottom of the vessel 14 can greatly be reduced by using nozzles of different cross-sectional areas.

Although the branch pipes 34a and 34b of FIG. 2 are so designed as to fulfill a=b and Da<Db in the above-mentioned embodiment, such conditions as a≠b and Da=Db may also be used. In this case, the pressure fluctuations based on the oscillations of bubbles generated from the two branch pipes can be synthesized in different phases on the inside of the container by properly selecting the pipe lengths a and b and staggering the time for the formation of the bubbles. The conditions, a≠b and Da=Db, also acts effectively on the pressure fluctuations due to the oscillations of steam regions generated from the two branch pipes, and the oscillation frequencies of pressure fluctuations based on these two regions can be different since the flow rates of steam in those branch pipes are different.

It may be understood from the description of the embodiment of FIGS. 2, 3A, 3B that the dynamic load applied to the primary containment vessel can be reduced by varying the size of the branch pipes in at least one of two measurements i.e. exhaust nozzle diameter and pipe length.

Although two branch pipes are used in the above-mentioned embodiment, three or more branch pipes may also be used so that they may be different from one another at least in one of the two measurements, i.e. nozzle diameter and pipe length. Thus, the pressure fluctuations generated in the vessel 14 are further fractionized and reach the container in various oscillation states, so that the reduction of the first and second dynamic loads may be facilitated.

Figure 5:
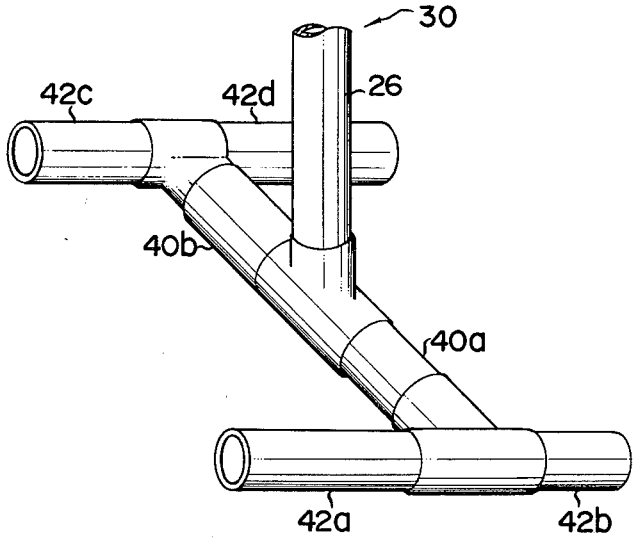
FIG. 5 is a perspective view of another embodiment of the exhaust section.

According to the above-mentioned embodiment, the steam exhaust section 30 of the distal end of the guide pipe is provided with two branch pipes. FIG. 5 shows another embodiment in which branch pipes 40a and 40b extending from the distal end portion of the guide pipe 26 substantially at right angles thereto and in opposite directions, plus branch pipes or second pipes 42a and 42b extending from the distal end of the branch pipe 40a substantially at right angles to both the guide pipe 26 and the branch pipe 40a and in opposite directions, and branch pipes or second pipes 42c and 42d extending from the distal end of the branch pipe 40b substantially in parallel with the branch pipes 42a and 42b and in opposite directions, for example. Thus, the exhaust nozzles for the gas and high-pressure steam are divided into four, and the pressure oscillations generated in the coolant on the basis of the gas and high-pressure steam ejected from the individual exhaust nozzles reach the primary containment vessel 14 in various oscillation states, so that the dynamic load applied to the vessel 14 may be reduced, as compared with the case of the embodiment of FIG. 2.

Figure 6A:
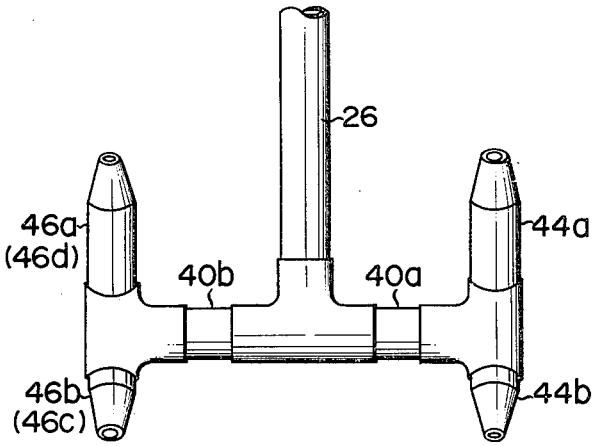
FIGS. 6A and 6B are front and side views of still another embodiment of the exhaust section, respectively.
Figure 6B:
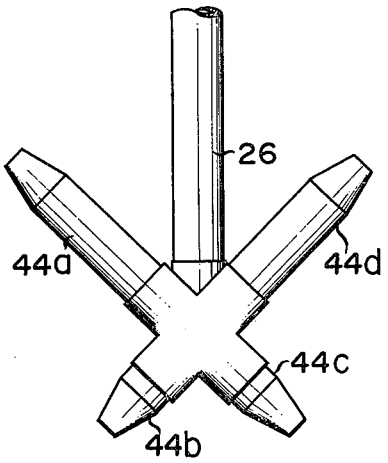

Although in FIG. 5, the branch pipes 42a, 42b, 42c and 42d are disposed in a plane substantially at right angles to the guide pipe 26, they may alternatively be disposed in planes substantially at right angles to the branch pipes 40a and 40b, severally, as shown in FIGS. 6A and 6B. In the structure of FIGS. 6A and 6B, each four branch pipes or second pipes 44a, 44b, 44c and 44d and 46a, 46b, 46c and 46d which are different in the aforesaid principal dimensions extend from the branch pipes 40a and 40b, respectively. In FIG. 6A four branch pipes 44c, 44d, 46c and 46d are not shown, and in FIG.

6B four branch pipes 46*a*, 46*b*, 46*c* and 46*d* are not shown.

Although this invention is applied to the overpressure steam condensing system of a boiling water reactor according to the above-mentioned embodiments, it is to be understood that the invention may also be applied to the steam exhaust sections of downcomers or various other plants and apparatus that require the condensing process as described herein.

What is claimed as new and desired to be secured by Letters Patent of the United States is:

1. A steam condensing apparatus comprising:

a container for holding a coolant in a liquid state;

a guide pipe having a first distal end connected through a safety valve to a source of a high pressure coolant in a gaseous state and a second distal end extending into said coolant in said container; and a plurality of branch pipes extending from said second distal end of said guide pipe and having exhaust nozzles at the forward ends thereof, in which when said safety valve is in an inoperative state, said coolant and air in said container enter into the branch pipes and guide pipe with the air forming an upper layer and the coolant forming a lower layer, and when said safety valve is operated to permit the high pressure coolant of the gaseous state to flow into the guide pipe, said coolant and said air in the guide pipe and branch pipes and high pressure coolant of the gaseous state passed through the safety valve are ejected through the nozzles into the coolant in the container;

wherein said branch pipes are arranged in pairs, the exhaust nozzles in each pair being spaced apart from one another by a degree sufficient to prevent a merger of bubbles formed by said ejected air in the coolant in the container and a merger of steam regions formed by said ejected coolant of the gaseous state in the coolant in the container, said steam regions forming gas-liquid interfaces where the coolant in the gaseous state condenses; and wherein at least one of the measures including the diameter of the nozzle and length of the branch pipe being different for each of said branch pipes.

2. A steam condensing apparatus according to claim 1, wherein said branch pipes consist of a pair of pipes extending respectively from the distal end of the guide pipe in opposite directions substantially at right angles to the guide pipe.

3. A steam condensing apparatus according to claim 2, in which each of said branch pipes of one said pair has a length at least equal to twice the diameter of one of nozzles provided on the forward end of one of said nozzles, said one of said nozzles having a greater diameter than does the nozzle of the other of said branch pipes.

4. A steam condensing apparatus according to claim 2, in which said nozzles of each said pair of said branch pipes are disposed at a distance at least equal to four times the diameter of one of said nozzles, said one of said nozzles having a greater diameter than does the nozzle of the other of said branch pipes.

5. A steam condensing apparatus according to claim 4, in which said branch pipes of each said pair have a length at least equal to twice the diameter of said one nozzle.

6. A steam condensing apparatus according to claim 1, wherein said branch pipes include a pair of pipes extending from the distal end of the guide pipe in opposite directions at right angles to the guide pipe, and a pair of second pipes extending in opposite directions from the distal end of each said pipes substantially at right angles to both the guide pipe and said pipes.

7. A steam condensing apparatus according to claim 6, in which the length of each said pair of second pipes is at least equal to twice the diameter of one of nozzles of said second pipes, said one of the nozzles having a greater diameter than that of the other of said nozzles of said pair of second pipes.

8. A steam condensing apparatus according to claim 6, in which said nozzles of each said pair of second pipes are disposed at a distance at least equal to four times the diameter of one of said nozzles, said one of said nozzles having a greater diameter than that of the other of said nozzles of said pair of second pipes.

9. A steam condensing apparatus according to claim 8, in which each said pair of second pipes has a length at least equal to twice the diameter of said one of said nozzles.

10. A steam condensing apparatus according to claim 1, wherein said branch pipes include a pair of first pipes extending from the distal end of the guide pipe in opposite directions substantially at right angles to the guide pipe, and four second pipes extending in a plane substantially at right angles to said first pipes from the distal end of each of said first pipes.

11. A steam condensing apparatus according to claim 10, in which said four second pipes have a length equal to, and in excess of, twice the diameter of one of nozzles provided on the forward end of the second pipes, said one nozzle having a greater diameter than that of the other.

12. A steam condensing apparatus according to claim 10, in which said nozzles of said second pipes are disposed at a distance at least equal to four times the diameter of one of said nozzles, said one of said nozzles having a greater diameter than that of the other of said nozzles of said second pipes.

13. A steam condensing apparatus according to claim 12, in which said four second pipes have a length at least equal to twice the diameter of said one nozzle.

* * * * *